United States Patent [19]

Gaulin

[11] Patent Number: 4,876,928

[45] Date of Patent: Oct. 31, 1989

[54] HAMMER HEAD HAVING REMOVABLE WEIGHT COMPONENTS

[76] Inventor: Philip E. Gaulin, HCR 1, Box 174, Palenville, N.Y. 12463-9712

[21] Appl. No.: 214,259

[22] Filed: Jul. 1, 1988

[51] Int. Cl.[4] ..... B25R 15/00

[52] U.S. Cl. ..... 81/20

[58] Field of Search ..... 81/20 R, 25, 26, 27

[56] References Cited

U.S. PATENT DOCUMENTS

| | | | |
|---|---|---|---|
| 1,144,035 | 6/1915 | Guy et al. | 81/22 |
| 1,781,344 | 11/1930 | Salazar | 81/22 |
| 2,755,833 | 7/1956 | Quayle | 81/25 |
| 2,788,815 | 4/1957 | D'Aoust | 81/26 |
| 3,211,198 | 8/1965 | Glasgow | 81/26 |
| 3,303,863 | 2/1967 | Titchnell | 81/20 |
| 3,605,832 | 9/1971 | Stephens | 81/25 |
| 3,704,734 | 12/1972 | Soto et al. | 81/20 |

*Primary Examiner*—Robert P. Olszewski
*Assistant Examiner*—Lawrence Cruz
*Attorney, Agent, or Firm*—Henderson & Sturm

[57] ABSTRACT

A hammer head construction (10) comprising: a hammer head member (11) provided with an elongated core recess portion (13); and, a plurality of weighted core inserts (12) comprising core insert members ((16)(16') wherein each of the individual core insert members (16)(16') have a different effective weight in the other core insert members (16)(16') and are adapted to be received on an individual basis in the core recess portion (13) to produce a hammer head construction (10) having different effective weights.

4 Claims, 1 Drawing Sheet

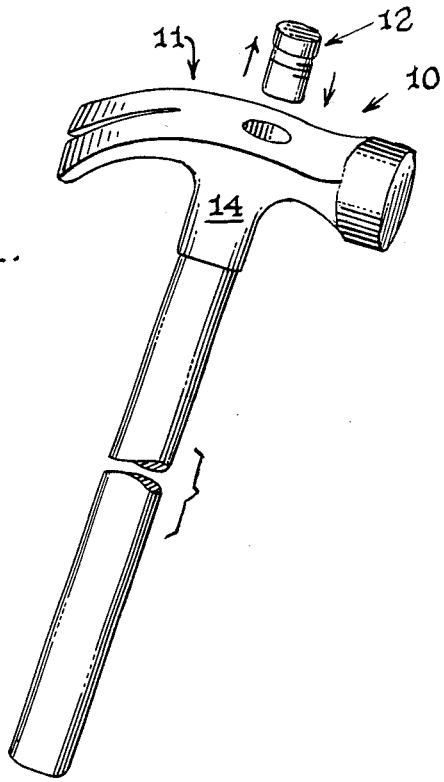
FIG. 1.
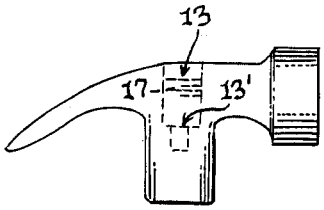
FIG. 2.
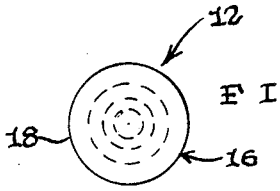
FIG. 3.
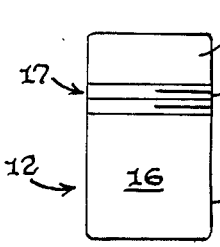
FIG. 4.
FIG. 5.
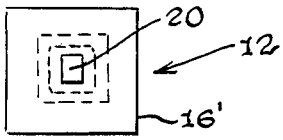
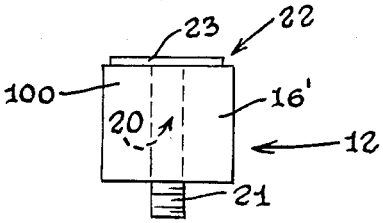
FIG. 6.

HAMMER HEAD HAVING REMOVABLE WEIGHT COMPONENTS

TECHNICAL FIELD

This invention relates to hammer constructions in general and more specifically to specialized hammer head constructions.

BACKGROUND OF THE INVENTON

This invention was the subject matter of Document Disclosure Program Registration No. 176890 which was filed in the U.S. Patent and Trademark Office on Sept. 4, 1987.

As can be seen by reference to the following U.S. Pat. Nos: 3,704,734; 1,781,344; 1,144,035; and 3,303,863 the prior art is replete with specialized hammer head constructions.

While most of the aforementioned hammer head constructions contain common structural features, each of the individual constructions were developed to perform a very specific specialized role such as: securing the hammer head to the handle; capturing a movable weight within the hammer head and/or handle; replacing a portion of the hammer head that is subject to wear; and, cushioning the impact that is transmitted between the hammer head and the handle.

Accepting the fact that all of the aforementioned prior art constructions are more than adequate for the particular purpose and function for which they were specifically designed; we are still left with the fact that none of the above cited patents provide for a means to vary the impact force transmitted by a single basic hammer head construction.

Anyone who uses a hammer to accomplish a variety of given tasks is all too well aware of the fact that may jobs require different weight hammer heads, which range from lightweight to medium weight to heavy weight. Under the present circumstances, the workman is forced to have different hammers having different head weights to effectively perform a variety of tasks.

BRIEF SUMMARY OF THE INVENTION

The hammer head construction that forms the basis of the present invention comprises in general a solid hammer head member having a centrally disposed hollow core portion that is dimensioned to receive like configured weighted core inserts. In addition, the hollow core portion and the weighted core inserts are provided with cooperating threaded means that are adpated to releasably secure the different weight core inserts relative to the hammer head member to vary the effective weight of the hammer head construction.

The weighted core inserts of this invention comprise a plurality of weighted insert members, wherein each of the individual insert members share the same general external configuration, however, each of the individual insert members have a weight that is different from the other insert members.

By virtue of the foregoing arrangement, the hammer head construction of this invention will have a minimum effective weight when none of the weighted core inserts are engaged in the hollow core portion of the hammer head member. On the other hand, when the user wishes to incrementally increase the effective weight of the hammer head construction, all that is required is the selection of an appropriately weighted insert member among the plurality of differently weighted insert members for insertion and threaded engagement with the hollow core portion of the hammer head member.

As a result of this new hammer head construction, the user will only be required to have a single hammer equipped with the hammer head member of this invention; whereby, the user may selectively vary the effective weight of the hammer by means of the removable weight components.

BRIEF SUMMARY OF THE DRAWINGS

These and other objects, advantages, and novel features of the invention will become apparent from the detailed description of the best mode for carrying out the preferred embodiment of this invention which follows; particularly when considered in conjunction with the accompanying drawings, wherein:

FIG. 1 is a perspective view of the hammer head construction of this invention;

FIG. 2 is an isolated cross-sectional view of the hammer head member;

FIG. 3 is a top plan view of a first embodiment of the weighted insert member;

FIG. 4 is a side plan view of the first embodiment of the weighted insert member;

FIG. 5 is a top plan view of a second embodiment of the weighted insert member; and, FIG. 6 is a side plan view of the second embodiment of the weighted insert member.

BEST MODE OF CARRYING OUT THE INVENTION

As can be seen by reference to the drawings and in particular to FIG. 1, the hammer head construction that forms the basis of the present invention is designated generally by the reference numeral (10). The hammer head construction (10) comprises in general a hammer head member (11) and a plurality of weighted core inserts (12). These structural components of the new hammer head construction (10) will now be described in seriatim fashion.

As can best be seen by reference to FIGS. 1 and 2, the hammer head member (11) is provided with a typical external hammer head configuration; wherein, the main structural distinction between the hammer head member (11) of this invention and a conventional hammer head construction (not shown) involves an elongated core recess portion (13) which is centrally disposed in the body (14) of the hammer head member (11); wherein, the core recess portion (13) terminates within the hammer head member (11) per se and does not extend into the handle portion (15) of the overall hammer construction.

As shown in FIGS. 3 and 4, in the first preferred embodiment of this invention the plurality of weighted core inserts (12) comprise elongated generally cylindrical core insert members (16) which are dimensioned and configured to be slideably received within the complimentary configured elongated centrally disposed core recess portion (13) formed in the hammer head member (11).

Turning now to the first preferred embodiment of the hammer head construction (10) depicted in FIGS. 1 thru 4, it can be seen that both the generally cylindrical core insert members (16) and the like configured core recess portion (13) are provided with threaded surface elements (17); wherein, the generally cylindrical core insert members (16) are provided with threaded surfaces (17') which are formed on their external periphery (18); and, wherein the core recess portion (13) is provided with threaded surfaces (17) which are formed in the walls of the hammer head member (11) which define the core recess portion (13).

As can be seen by reference to FIGS. 2, 5, and 6 in the second preferred embodiment of the hammer head construction (10), the generally rectangular core recess portion (13) is further provided with a reduced diameter downwardly depending threaded auxiliary recess (13') (shown in phantom) whose purpose and function will be described shortly.

The plurality of weighted core inserts (12) of this invention are intended to comprise core insert members (16) or (16') having different effective weights; whereby, the insertion of different weighted core inserts (12) will provide the user with a hammer head construction (10) having a wide variety of effective weights.

While there are many suitable ways to provide a plurality of weighted core inserts (12) having different weights such as filling the individual core insert with material having different specific gravities, such as sand, lead, and mercury, this invention also contemplates the use of a heavy metal as the basic core insert material; wherein, the heaviest core insert (12) ahs the largest mass of the particular metal chosen; while the lightest core insert (12) has the smallest mass of the particular metal chosen.

As can be seen by reference to FIGS. 3 and 5, this invention contemplates the selective removal of material (as shown by the dashed lines) from the center of each of the core insert members (16, 16') to produce weighted core inserts (12) having different weights.

Turning now to FIGS. 5 and 6, it can be appreciated that the generally rectangular core insert member (16') is provided with a central aperture (20) which is dimensioned at a minimum to receive the threaded stem (21) of a securing member (22) having an enlarged head element (23); wherein, the threaded stem (21) of the securing member (22) is dimensioned to threadingly engage the auxiliary recess (13'); and, the enlarged head element (23) is dimensioned to overlie the top of the generally rectangular core insert member (16').

When a person wishes to use the new hammer head construction (10) having the generally cylindrical core recess portion (13) and the generally cylindrical weighted insert members (16); all that is required is a selection of the desired weight insert member (16), which is subsequently rotatably and threadedly engaged with the threaded surfaces (17) that are formed in the walls of the core recess portion (13).

On the other hand, when a person wishes to use the new hammer head construction (10) having the generally rectangular core recess portion (13) and the generally rectangular weighted insert members (16'); all that is required is a selection of the desired weight insert member (16'), which is dropped into and secured relative to the core recess portion (13) by the threaded engagement of the threaded stem (21) of the securing member (22) with the threaded auxiliary recess (13') of the core recess portion (13).

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended

I claim:

1. A new hammer head construction comprising:

a hammer head member having an elongated core recess portion which is centrally disposed in the body of the hammer head member; and, a plurality of weighted core inserts which are dimensioned to be received in a nested fashion relative to one another within the core recess portion of the hammer head member; wherein, each of the plurality of weighted core inserts comprise individual core insert members; wherein, each of the core insert members have a different effective weight from the other core insert members; wherein, the core recess portion and the plurality of weighted core inserts have a generally rectangular configuration.

2. The hammer head construction of claim 1, wherein the core recess portion is further provided with an auxiliary threaded recess.

3. The hammer head construction of claim 1, wherein each of the generally rectangular weighted core inserts are provided with a central aperture.

4. The hammer head construction of claim 2, further comprising: a securing member having an enlarged head element and an elongated threaded stem; wherein, the enlarged head element is dimensioned to overlie the generally rectangular weighted core inserts and the threaded stem is adapted to engage the auxiliary threaded recess in the core recess portion.

* * * * *